US009168730B2

(12) United States Patent
Hill et al.

(10) Patent No.: US 9,168,730 B2
(45) Date of Patent: Oct. 27, 2015

(54) PRINTING LAYERS OF CERAMIC INK IN SUBSTANTIALLY EXACT REGISTRATION BY DIFFERENTIAL INK MEDIUM THERMAL EXPULSION

(71) Applicant: CONTRA VISION LIMITED, Bramhall, Stockport, Cheshire (GB)

(72) Inventors: George Roland Hill, Bramhall (GB); Gail Eaton, Kidsgrove (GB); Robert Schroeder, Polaski, GA (US)

(73) Assignee: CONTRA VISION LIMITED, Bramhall, Stockport, Cheshire (GB)

( * ) Notice: Subject to any disclaimer, the term of this patent is extended or adjusted under 35 U.S.C. 154(b) by 0 days.

(21) Appl. No.: 14/327,060

(22) Filed: Jul. 9, 2014

(65) Prior Publication Data

US 2014/0318396 A1 Oct. 30, 2014

Related U.S. Application Data

(63) Continuation of application No. 13/142,680, filed as application No. PCT/GB2009/002972 on Dec. 29, 2009.

(30) Foreign Application Priority Data

Dec. 31, 2008 (GB) ..... 0823712.5
Jan. 9, 2009 (GB) ..... 0900307.0

(51) Int. Cl.
*B05D 1/34* (2006.01)
*B41M 1/18* (2006.01)
(Continued)

(52) U.S. Cl.
CPC . *B41F 15/00* (2013.01); *B05D 1/32* (2013.01); *B05D 1/34* (2013.01); *B41J 2/14032* (2013.01);
(Continued)

(58) Field of Classification Search
CPC ..... B05D 1/32; B05D 1/34; B05D 1/38; B41M 1/12; B41M 1/18; B41M 1/34
USPC ..... 101/491
See application file for complete search history.

(56) References Cited

U.S. PATENT DOCUMENTS 3,898,362 A 8/1975 Blanco
4,321,778 A 3/1982 Whitehead
(Continued)

FOREIGN PATENT DOCUMENTS

DE 199 46 712 4/2001
EP 0 880 439 12/1998
(Continued)

OTHER PUBLICATIONS

International Search Report as issued for International Application No. PCT/GB2009/002972, dated Dec. 6, 2010.
(Continued)

*Primary Examiner* — Daniel J Colilla
*Assistant Examiner* — John M Royston
(74) *Attorney, Agent, or Firm* — Pillsbury Winthrop Shaw Pittman LLP

(57) ABSTRACT

A method of partially imaging a substrate, for example glass, with a print pattern comprising layers of ceramic ink in substantially exact registration. The method relies on a mask ink layer defining the print pattern and differential thermal expulsion of ceramic ink medium during a heat fusing process between the areas outside the print pattern and within the print pattern. This results in pigment and glass frit forming a durable image material adhered to the substrate within the print pattern and non-durable material outside the print pattern, enabling its removal outside the print pattern to leave the desired layers of ceramic ink within the print pattern in substantially exact registration.

12 Claims, 13 Drawing Sheets

(51) Int. Cl.

| | |
|---|---|
| ***B41M 1/34*** | (2006.01) |
| ***B41F 15/00*** | (2006.01) |
| ***B05D 1/32*** | (2006.01) |
| ***B41J 2/14*** | (2006.01) |
| ***B41J 2/16*** | (2006.01) |
| ***B41M 1/12*** | (2006.01) |
| ***B44C 1/17*** | (2006.01) |
| ***B44C 3/02*** | (2006.01) |
| ***B44C 5/04*** | (2006.01) |

(52) U.S. Cl.

CPC ..... *B41J 2/164* (2013.01); *B41J 2/1631* (2013.01); *B41M 1/12* (2013.01); *B41M 1/18* (2013.01); *B41M 1/34* (2013.01); *B44C 1/17* (2013.01); *B44C 3/02* (2013.01); *B44C 5/0407* (2013.01)

(56) References Cited

U.S. PATENT DOCUMENTS

| | | | | |
|---|---|---|---|---|
| 5,132,165 | A | 7/1992 | Blanco | |
| 5,665,472 | A | 9/1997 | Tanaka et al. | |
| 5,702,653 | A * | 12/1997 | Riley | 264/614 |
| 5,830,529 | A | 11/1998 | Ross | |
| RE37,186 | E | 5/2001 | Hill | |
| 7,121,197 | B2 * | 10/2006 | Geddes et al. | 101/34 |
| 2004/0265492 | A1 | 12/2004 | Free et al. | |
| 2005/0170107 | A1 | 8/2005 | Darsillo et al. | |
| 2006/0112729 | A1 * | 6/2006 | Sakoske | 65/106 |
| 2006/0150680 | A1 * | 7/2006 | Hill et al. | 65/60.2 |

FOREIGN PATENT DOCUMENTS

| | | |
|---|---|---|
| EP | 1 207 050 | 5/2002 |
| GB | 2 165 292 | 4/1986 |
| GB | 2 174 383 | 11/1986 |
| GB | 2 188 873 | 10/1987 |
| WO | WO 98/43832 | 10/1998 |
| WO | WO 99/58343 | 11/1999 |
| WO | WO 00/46043 | 8/2000 |
| WO | WO 2004/030935 | 4/2004 |

OTHER PUBLICATIONS

International Preliminary Report on Patentability as issued for International Application No. PCT/GB2009/002972, dated Jul. 14, 2011.

* cited by examiner

PRINTING LAYERS OF CERAMIC INK IN SUBSTANTIALLY EXACT REGISTRATION BY DIFFERENTIAL INK MEDIUM THERMAL EXPULSION

CROSS REFERENCE TO RELATED APPLICATIONS

This is a continuation of U.S. patent application Ser. No. 13/142,680, filed Jun. 29, 2011, which is the U.S. National Phase of PCT/GB2009/002972, filed Dec. 29, 2009, which in turn claims priority to British Patent Application No. 0823712.5, filed Dec. 31, 2008 and British Patent Application No. 0900307.0, filed Jan. 9, 2009, the contents of each of which are incorporated herein in their entirety by reference.

FIELD OF THE INVENTION

This invention concerns the partial imaging of a substrate, for example glass, with a print pattern comprising layers of ceramic ink in substantially exact registration.

BACKGROUND TO THE INVENTION

Ceramic printing on glass is well known. U.S. Pat. No. 4,321,778 (Whitehead), U.S. Pat. No. RE 37,186 (Hill), WO 00/46043 (Hill and Clare), WO 98/43832 (Pearson) and U.S. Pat. No. 5,830,529 (Ross) disclose partially printed glass panels with a plurality of superimposed layers, including panels variously described as one-way vision panels, vision control panels or see-through graphics panels, and methods of producing such panels. U.S. Pat. No. RE 37,186 describes several methods for the partial printing of a transparent substrate with an opaque "silhouette pattern" comprising layers of ink in substantially exact registration, to produce a panel having a design visible from one side but not visible from the other side and, optionally, a black layer facing the other side to maximise "through vision" from the other side. Three of these methods are referred to as the "direct", "stencil", and "resist" methods, all of which involve the removal of cured ink to leave the desired "silhouette pattern" in substantially exact registration. This removal of unwanted ink is undertaken by the application of an overall force applied to the superimposed layers of ink (in the case of the direct and stencil methods) or an overall application of solvent in the case of the resist method. GB 2 188 873 (Hill) discloses improvements to these methods of printing with substantially exact registration and discloses the lateral registration of separately printed areas of ink. WO 00/46043 (Hill and Clare) discloses a range of methods of printing such panels with ceramic ink in substantially exact registration, unified by the printing of superimposed layers onto a base layer and the removal of unwanted ink by a selective force.

WO 04/030935 (Hill and Quinn) also discloses the partial printing of glass panels with ceramic ink in a plurality of layers in substantially exact registration. The substantially exact registration is achieved by the printing of superimposed layers of ink, one of the layers comprising ink with a high proportion of glass frit in a "print pattern". These layers of ink may be applied directly to a sheet of glass or be transferred as a decal onto a sheet of glass. The glass and the applied layers of ink are subjected to a heat treatment which causes the glass frit to fuse to the glass and bind the layers of ink to the glass within the print pattern. The ink not within the print pattern is burnt off in the heat treatment process and/or otherwise removed in a subsequent finishing process, to leave the desired layers of ceramic ink in substantially exact registration within the print pattern. The invention can be used for the manufacture of one-way vision panels and other products in which the substantially exact registration of layers of ink with at least one common boundary on glass is desired. Alternatively, areas of ink with spaced apart boundaries are laterally registered one to the other. This method has been referred to as the "frit-loaded" method as the substantially exact registration of layers is achieved by "excess" glass frit in one ink layer defining the print pattern. A disadvantage of this method is that any exposed layer initially without frit has a relatively matt appearance compared to conventional ceramic ink fused into glass. Also, so-called one-way vision panels featuring a design visible on one side which is desired not to be visible from the other side optionally comprise a single layer of black frit-loaded ink, which typically has a glossy appearance in some areas but has a relatively matt appearance in other areas of the same black ink in which part of the frit has migrated into a design ink layer. This inconsistent appearance causes a "ghost image" of the design to be visible from the other side, which is typically not desired.

Ceramic ink typically comprises glass "frit", metal oxide pigments and an ink medium, typically of solvent, resin and plasticiser, in which the pigment and frit are suspended. Frit is glass which has been melted and quenched in water or air to form small particles, which are then ground or "milled" to a desired maximum particle size, typically 10 micron. Ceramic ink may contain oil such as pine oil. Ceramic inks can be opaque or translucent. The ink medium is sometimes referred to as just a medium, a binding medium or a matrix.

Solvent in a ceramic ink medium evaporates following printing, in an ink drying or curing process, leaving resin and plasticiser in the interstices between the glass frit and pigment.

Removal of this resin and plasticiser matrix in the firing of ceramic inks is potentially problematical and a "slow-firing" regime is generally considered preferable, although the firing of ink in a relatively short toughening cycle is known in the art.

The glass is optionally toughened, sometimes referred to as tempered, in the heat treatment process, typically as a second stage following a first stage slow heat treatment process or "ink fusing regime" in which the print pattern is fused to the glass.

GB 2 174 383 (Easton and Slavin) discloses methods of decorating glass with ceramic ink by means of waterslide transfer and a single stage toughening and decal fusing process.

Another type of vision control panel is disclosed in EP 0880439, comprising a transparent or translucent sheet and a transparent or translucent "base pattern" of a different colour to the "neutral background" of the sheet.

Known methods of ceramic decal transfer include:

(i) indirect transfers, for example waterslide transfers and indirect heat release transfers, and (ii) direct transfers, for example direct heat release transfers.

A transfer process comprises material to be transferred, commonly referred to as a decal (abbreviation of decalcomania), being transferred from a transfer carrier, commonly referred to as a decal carrier, onto a substrate surface.

An indirect transfer method is one in which the means of release of the decal from the decal carrier and the means of adhering the decal to the substrate are typically combined in a single layer on the transfer carrier. The decal is first removed from the carrier and then positioned on the substrate by means of a pad, roller, by hand or other intermediate surface.

For example, a ceramic ink waterslide transfer typically comprises a mass produced decal carrier, typically a specially prepared paper with a sealant layer and a water-soluble adhesive layer. This is optionally printed or otherwise coated with a downcoat, typically a methyl methacrylate based lacquer. It is then printed with the desired layers of ceramic ink forming the required image and then a covercoat is applied, typically a butyl or methyl methacrylate based lacquer. This transfer assembly is typically soaked in water and the decal comprising the covercoat, ceramic ink, optional downcoat and some adhering water-soluble adhesive is released from the carrier and then applied to the substrate surface to be decorated, typically by hand.

As another example, an indirect ceramic ink heat release transfer typically comprises a mass-produced decal carrier, comprising a paper, a sealant layer, a combined heat-activated release and adhesive layer, typically a modified wax incorporating an adhesive or tackifier blend. This is optionally printed or otherwise coated with a downcoat, typically a methyl methacrylate lacquer. It is then printed with the desired layers of ceramic ink and then a covercoat is applied, typically a butyl or methyl methacrylate based lacquer. The decal is then released by applying heat, typically by a heated steel plate under the paper, which activates the release/adhesive layer and allows the decal to be removed from the carrier and then be transferred to and adhered to the substrate to be decorated via an intermediate pad, roller or by hand.

A direct transfer method is one in which a transfer assembly is applied directly to a substrate and the decal carrier is released and removed, leaving the decal on the substrate.

For example, a direct ceramic ink heat release transfer typically comprises a mass-produced decal carrier comprising paper, a sealant layer and a heat release layer, typically a polyethylene glycol (PEG) wax. This is optionally printed with a covercoat, typically a film forming covercoat, for example of butyl or methyl methacrylate. It is then printed with the desired layers of ceramic ink. Any design is printed in reverse to its intended orientation from the ink side of the substrate. Then a heat-activated adhesive layer is applied, for example a methacrylate resin. This transfer assembly is then typically positioned directly against the substrate with the adhesive layer against the substrate surface. Heat is applied via the paper, which simultaneously activates the adhesive layer and the separate heat release agent. This enables the decal of adhesive, ceramic ink and any covercoat to be adhered to the substrate and be transferred from the carrier, the carrier being released and removed from the decal and substrate. The substrate may optionally be pre-heated.

The terms "covercoat" and "downcoat" are always used in relation to their position with respect to the substrate, a covercoat being a layer over the ink on the substrate and a downcoat being a layer adhered to the substrate, underneath the ink on the substrate.

Typical substrates onto which ceramic decals are transferred include ceramic holloware, ceramic flatware, hollow glassware and flat glass.

All of the above transfer materials and methods are well known in the art.

Many automatic methods of decal application have been devised, for example all the mechanical processes, firing ovens and furnaces described in WO 98/43832.

After ceramic ink is applied to a normal sheet of flat glass, sometimes referred to as float glass and sometimes referred to as annealed glass, the printed sheet of glass is then typically subjected to a thermal regime of up to a temperature of typically 570° C., which burns off all components of the ceramic ink other than glass frit and pigment and melts the glass frit and fuses the remainder of the ink onto the glass, typically followed by relatively slow cooling to anneal the glass once again, which process will be referred to as an "ink fusing regime". Optionally, annealed glass substrates with ceramic ink can undergo a tempering or toughening regime, which involves raising the glass temperature to typically between 670° C. and 700° C., in which temperature range the glass is relatively soft, and then cooling it relatively quickly, typically by cold air quenching. This causes differential cooling of the glass sheet, the two principal surfaces solidifying before the core solidifies. The subsequent cooling and shrinkage of the core causes a zone of precompression adjacent to each principal surface. The physical strength properties of the glass sheet are fundamentally changed by this glass tempering or toughening regime, which imparts a considerably improved flexural strength to the resultant tempered or toughened glass. Such a glass tempering or toughening regime may be carried out after a separate ink fusing regime or as one process, the ink being fused onto the glass as part of that one process.

With either the ink fusing regime or the glass tempering regime, any transfer process adhesive, covercoat, downcoat and ceramic ink medium are burnt off in the furnace and do not form part of the resultant panel.

It is known in the art to print a design using ceramic ink with a relatively low proportion of glass frit, to intensify the perceived colours, and then overprint with an overall layer of clear transparent ceramic ink with glass frit, sometimes referred to as flux, to "bind in" the pigments below. U.S. Pat. No. 3,898,362 (Blanco) discloses a method of producing an overglaze ceramic decal by wet printing a design layer, free of glass, on a backing sheet and separately depositing a protective coating of pre-fused glass flux on the wet design layer. U.S. Pat. No. 5,132,165 (Blanco) and U.S. Pat. No. 5,665,472 (Tanaka) disclose improvements to this process. Blanco also discloses the prior art lithographic decal method of printing a layer of the desired pattern for one pigment in a clear varnish and then dusting the pigment of the entire sheet in a lithographic process, cleaning the sheet and leaving the pigment only where the varnish is. If more than one colour is required, the process must be repeated and dried between each stage.

EP 1 207 050 A2 (Geddes et al) discloses a transfer system in which a digitally printed ceramic colorant image is applied to a backing sheet followed by an overall overcoat containing frit and binder. Geddes also discloses the thermal transfer digital printing of inks without frit.

BRIEF DESCRIPTION OF THE INVENTION

According to one aspect of the present invention, there is a method of partially imaging a substrate with a plurality of layers within a print pattern which subdivides the substrate into a plurality of discrete printed areas and/or a plurality of discrete unprinted areas, said layers being in substantially exact registration, said method comprising the steps of:

(i) applying a plurality of layers of ink to the substrate, said plurality of layers of ink comprising ink medium, said ink medium comprising a first ink medium and another ink medium which may be the same or different, wherein one of said layers of ink comprises a mask ink layer which defines said print pattern, said mask ink layer comprising said first ink medium, and another of said layers of ink comprises pigment and glass frit and said another ink medium, (ii) subjecting said substrate and said plurality of layers of ink to a heat fusing process, wherein during said heat fusing process said ink medium undergoes differential thermal expulsion outside said print pattern compared to inside said print pattern, and said pigment and said glass frit forms a durable image material adhered to said substrate within said print pattern and does not form a durable image material outside said print pattern, and (iii) removal of parts of said another of said layers outside said print pattern, wherein said parts are burnt off and/or vapourised during said heat fusing process and/or are substantially removed by a subsequent finishing process.

According to a particular aspect of the invention, a substrate is coated with a plurality of layers of ink, at least one of the layers comprising ceramic ink which comprises glass frit. The ink layers are typically applied by printing or decal, and then fired in a heat treatment furnace. The print pattern is created by the mask ink layer and typically by differential thermal expulsion of ink medium in the heat fusing process. Within the print pattern the required layers of pigment and frit form durable image material, fused to the substrate. Outside the print pattern, the proportion and/or composition of the ink medium prevents or substantially prevents the fusing of the pigment and frit to the substrate.

The substrate is capable of withstanding a heat fusing process in which glass frit is melted, example substrates including a sheet of glass, hollow glassware stove enamelled steel or a ceramic article. The melting point of ceramic ink glass frits typically range from about 350° C. upwards.

The method is used to make a variety of products, for example glass one-way vision panels or other vision control panels, stove enamelled steel signs or decorative ceramic objects.

The "print pattern" is defined as subdividing the substrate into a plurality of discrete printed areas and/or a plurality of discrete unprinted areas. The print pattern for a vision control panel is typically a pattern of dots, straight or curved lines or other plurality of discrete areas of marking material and/or a plurality of areas devoid of marking material, for example in the form of a grid, net or filigree pattern. The print pattern may be uniform or non-uniform, such as in a vignette pattern. Alternatively, the print pattern is totally irregular, for example indicia forming a sign. The terms "within the print pattern" and "inside the print pattern" are used to refer to the discrete areas or interconnected areas of the print pattern that remain imaged in the partially imaged substrate after the removal of unwanted ink. Conversely, the term "outside the print pattern" is used to refer to the area or areas of the substrate that are desired to be unimaged in the partially imaged substrate, typically the area or areas from which unwanted ink has been removed.

Ceramic ink typically comprises pigment, glass frit and an ink medium (sometimes referred to as a binding medium or matrix), the ink medium typically comprising solvent, resin and plasticiser and/or an oil such as pine oil or comprising curable resin, for example UV curable resin. The pigment is a colourant of the clear frit or flux.

The layers of ink are typically screenprinted directly onto the substrate or are applied to the substrate in the form of a decal transferred from a pre-printed decal carrier. Decals are optionally indirectly applied, for example waterslide transfer decals, or are directly applied from a carrier, typically by means of heat and pressure.

The ink medium is typically transformed from solid state to gaseous state in one of two ways. With rising furnace temperature, either the solid ink medium is directly carbonised and "burnt off" at a so-called thermal degradation temperature, or it may pass through a molten or liquid phase before being vapourised. In normal prior art practice, different resins can advantageously be selected in different layers of ink typically to allow, in a gradually raised temperature regime, for resin in an upper layer to be "burnt off" or vapourised before the resin in the layer below it. This progressive or sequential expulsion of resin from different layers minimises disturbance of the layers of pigment and/or frit and the defects commonly associated with the firing of superimposed layers of ink.

Conversely, it has been found that selection of an appropriate ink medium or combination of ink mediums or simply a higher proportion of the same ink medium outside the print pattern compared to inside the print pattern, can selectively cause ink layers outside the print pattern not to form durable imaging material following heat treatment in a furnace but be capable of subsequent removal, for example by air or water jetting. In the firing process, the continued expulsion of the ink medium prevents substantial binding of other ink components to the substrate. Optionally, the ink in the area or areas outside the print pattern erupts in the furnace, further facilitating subsequent removal of unwanted ink. Typically, the proportion by weight of the ink medium in the plurality of layers of ink upon commencement of the heat fusing process to the weight of molten glass frit in the plurality of layers of ink at the highest temperature of the heat fusing process is greater outside the print pattern than within the print pattern. Outside the print pattern, the expulsion of the medium preferably causes disruption of the ink layers in the form of local fracturing, assisting its subsequent removal. The thermal cycle of temperature/time of the heat fusing process is optionally selected such that the medium within the print pattern is steadily removed into the internal atmosphere of the furnace, preferably before the melting point of the glass frit is reached, whereas outside the print pattern a proportion of the medium preferably remains when the glass frit has melted, causing disruptive expulsion of the remaining medium in the form of gaseous matter through the liquid frit. Optionally, the continued expulsion of medium outside the print pattern substantially prevents the fusing of the melted frit and contained pigment to the glass surface, whereas such fusion takes place within the print pattern.

As well as one-way vision control panels, typically having a print pattern of dots or lines, the method can be used to make a variety of other products in which substantially exact registration is desired. For example, it is known that the colours of a design are typically required to be seen on a white background. The method enables a coloured design, for example an architectural "no exit" sign in red indicia on a glass door, to be printed with a white layer exactly underlying each red letter character, the perimeter of each layer being in substantially exact alignment. A plurality of the areas comprise a plurality of superimposed layers of ink with a common length of boundary or perimeter.

As another example, the method is also used to register single layers of different colours laterally, for example one of the areas of the print pattern is of a different colour and is spaced from another of the areas of the print pattern, the two areas being in accurate register. For example, a decorative architectural glass partition panel comprises alternate red and grey lines. Conventional prior art methods of printing inevitably suffer from lack of registration. Typically, the two sets of coloured lines, applied using two different screen printing screens, would suffer from different spacing between the lines in different parts of a single panel and in different panels in such a production run.

Optionally, the ink fusing regime comprises a heat fusing process in which the printed substrate, typically an annealed glass sheet, is raised up to a temperature of typically 570° C., which burns off all components of the ceramic ink other than glass frit and pigment melts the glass frit and fuses the remainder of the ink within the print pattern onto the glass.

Optionally, the heat fusing process is a glass tempering process, which involves raising the glass temperature to typically between 670° C. and 700°, in which temperature range the glass is relatively soft, and then cooling it relatively quickly, typically by cold air quenching.

Optionally, a glass tempering process is a second heat process undertaken separately and following the heat fusing process.

Example embodiments of the invention will now be described in relation to FIGS. 1A-5G, which are diagrammatic, not-to-scale cross-sections through a panel illustrating the sequential stages of different embodiments of this method to produce panels having superimposed layers of ink with substantially exact registration, in which the substrate, for example a glass sheet 10, is directly printed. It should be understood that the illustrated layers of ink can alternatively first be printed on a decal carrier and either directly or indirectly applied to the glass sheet 10 from the carrier. It should also be understood that the method is applicable to substrates other than glass, for example ceramic substrates.

Figure 6A:
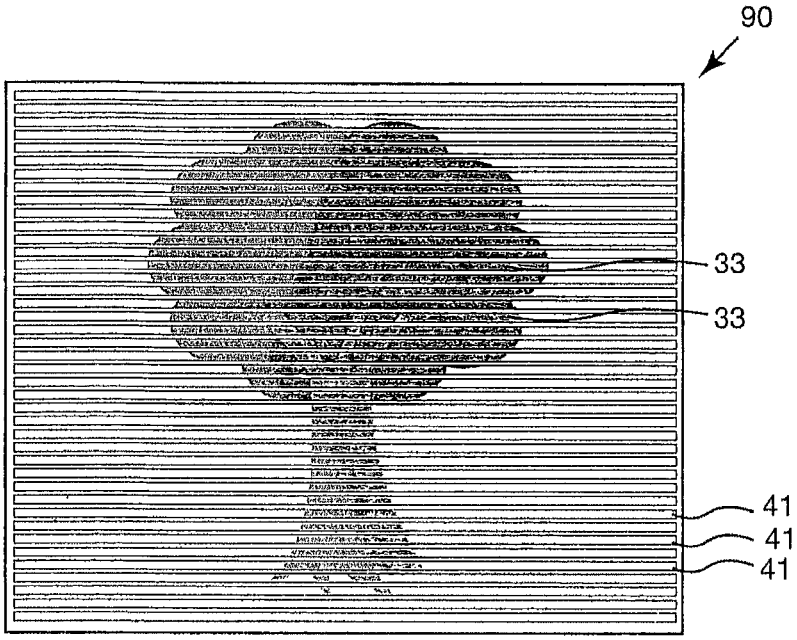

FIGS. 6A and B are diagrammatic elevations of two sides of a panel made by the method of the invention.

EMBODIMENT 1

Differential Thermal Expulsion of Ink Medium from a Stencil Mask

In a first embodiment of the invention, the differential expulsion of ceramic ink medium is created by applying a "stencil mask" of the print pattern (a negative layout of the print pattern, deposited outside the print pattern) to a sheet of glass, typically annealed, untempered glass. The stencil ink comprises ink medium, optionally comprises no pigment and optionally comprises no glass frit, optionally comprises only materials found in a conventional ceramic ink medium, for example solvent, resin and plasticizer, optionally also comprises a filler to assist the printability of the required ink medium constituents, the filler optionally also providing a barrier layer to the migration of solid or molten glass frit or pigment during the heat fusing process.

FIGS. 1A-H disclose the stages of making a simple one-way vision panel comprising a print pattern of uniform colour visible from one side of a sheet of glass and another colour visible from the other side of the sheet of glass.

Figure 1A:
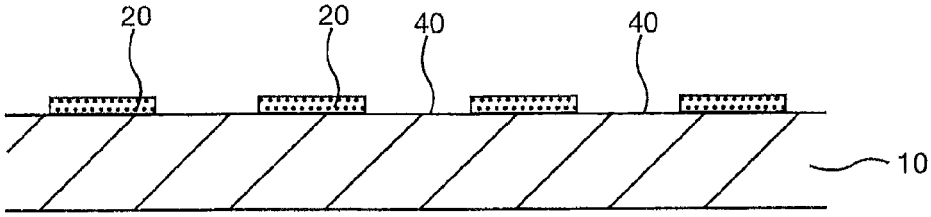
FIGS. 1A-1H are diagrammatic cross-sections of stages of the first embodiment in which the mask is a stencil of the required print pattern.

In FIG. 1A, stencil ink layer 20 is applied to glass sheet 10 in the form of a negative of the print pattern, leaving print pattern portions 40 unprinted. For example, if a print pattern of dots is required, the stencil ink layer 20 is typically screen-printed over the continuous area surrounding the dots, which is required to be an unprinted, transparent area in the finished product. Subsequent layers of ink are then applied over the stencil ink layer 20 and the exposed glass areas required to form the print pattern 40 in the finished product.

Figure 1B:
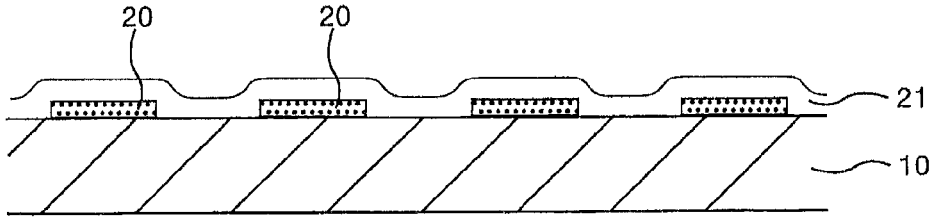
Figure 1C:
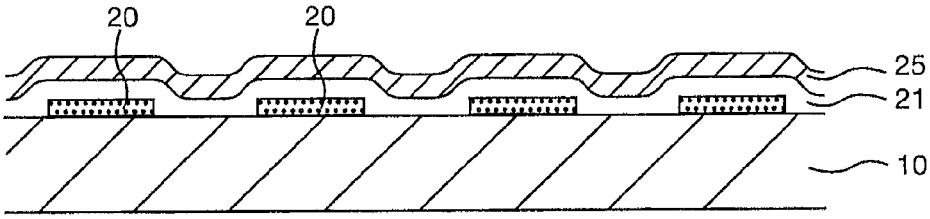
Figure 1D:
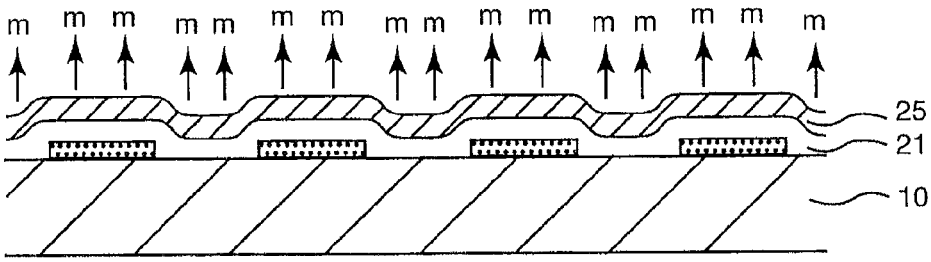

First ceramic ink layer 21 of a first colour is applied uniformly, typically screenprinted, over the stencil ink layer 20 and print pattern portions 40 of the panel, as shown in FIG. 1B, followed by second ceramic ink layer 25 of a second colour different to the first colour, in FIG. 1C. Each layer of ink typically comprises solvents and each layer is cured or dried before applying the next layer, typically by applying forced hot air in a drying tunnel, which evaporates the majority and ideally all of the solvent in one layer before applying the next layer, for example curing the stencil ink layer 20 before printing the first ink layer 21, and curing the first ink layer 21 before printing the second ink layer 25. The printed and cured panel of FIG. 1C is heated in a furnace to drive off any remaining ink solvent and other constituents of the ink medium, as represented by the arrows 'm' in FIG. 1D.

Figure 1E:
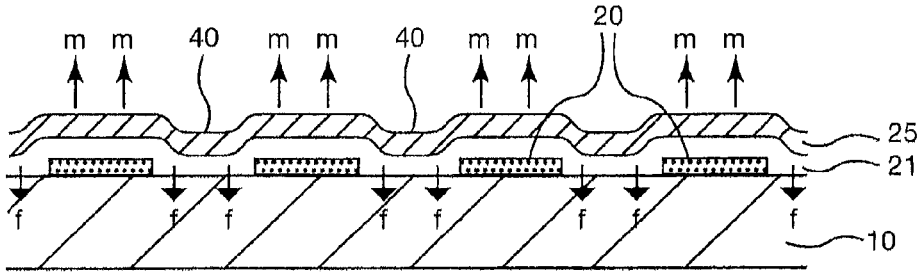
Figure 1F:
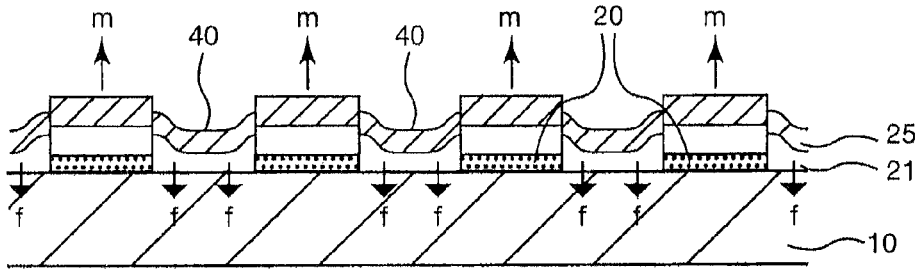
Figure 1G:
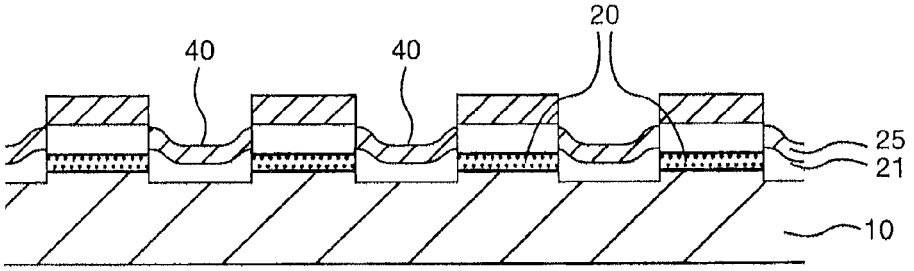
Figure 1H:
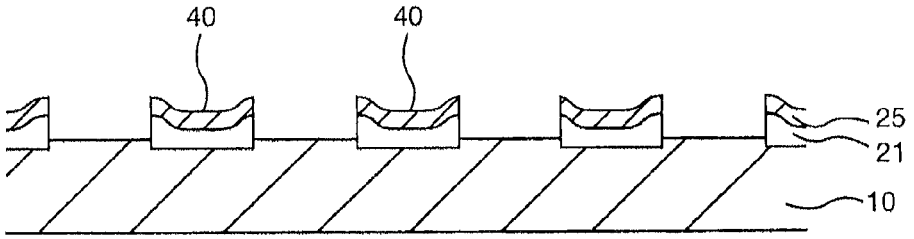

In FIG. 1E, the ink medium emission continues and, as the temperature of the furnace is raised above the melting point of the glass frit in ink layers 21 and 25, the glass frit melts to bind and fuse with the ink pigments and to the glass surface within the print pattern portions 40, as represented by the arrows 'f'. In contrast, in portions outside the print pattern, the ink medium constituents continue to be emitted from the stencil layer 20 and ink layers 21 and 25. This continued movement of typically liquid or gaseous matter away from the surface of glass sheet 10, together with any barrier effect of other stencil ink constituents, prevents any substantial amount of solid pigment or molten frit in the ink layers outside the print pattern fusing or even bonding to any substantial degree to glass sheet 10. The greater amount and/or proportion of ink medium in the layers outside the print pattern 40 compared to inside the print pattern 40 ensures this differential thermal expulsion of ink medium in the heat process. This differential thermal expulsion is optionally assisted by the type of ink medium in the stencil ink layer 20, for example being more volatile than the ink medium in the first and/or second ceramic ink layers 21 and 25. The continued expulsion of ink medium constituents from the stencil ink layer 20 optionally and advantageously results in the eruption of the surface of ink layer 25 and preferably of ink layers 21 and 25 outside the print pattern, resulting in the surface of ink layer 25 being raised outside the print pattern 40 compared to inside the print pattern 40. Inside the print pattern 40, the first ceramic ink layer 21 is being progressively fused to glass sheet 10 in FIG. 1F, shown diagrammatically as becoming embedded within the surface layer of glass sheet 10 in FIG. 1G. Following cooling, removal from the furnace, and typically further cooling, the unwanted ink outside the print pattern portions 40 is removed, for example by water or air jetting, to leave the finished panel of FIG. 1H with ceramic ink layers 21 and 25 in substantially exact registration within print pattern 40.

It has been found in reducing the invention to practice that a first ink medium with a relatively high "green strength" is preferred for the method of this first embodiment, for example Ferro ink medium 1597 manufactured by Ferro Corporation (US). It has also been found that the ink medium in the different layers can be similar or identical, comprising the same constituents, optionally in the same proportions. For example, it has been shown in reducing the invention to practice that Ferro ink medium 1597 is optionally used in the stencil layer 20 and two other layers of ink, for example, a black first ink layer 21 and a white second ink layer 25.

Optionally, stencil ink layer 20 contains a filler or other constituents to assist the printing process of the ink, which optionally contains no glass frit or conventional ceramic ink pigment.

Optionally, the differential ink medium thermal expulsion is complemented by a filler in the stencil layer ink acting as a physical barrier or partial barrier layer to solid or melted frit or pigment above the stencil layer reaching the glass surface and thus preventing glass frit and pigment fusing to the glass surface. To be effective, such a filler should form a barrier, together with any remaining medium, throughout the heat fusing process. An example filler is glass frit of a melting point higher than the maximum temperature of the heat process or firing cycle. Preferably the filler is of particle shape and particle size distribution such that interstices between larger particles are partly filled with smaller particles, thus providing a more effective barrier to molten frit or solid particle migration. Flat or lamellar filler particles, for example micaceous (silicate) platelets that overlap and adhere to each other comprise an optional physical barrier to the migration of molten glass frit.

As a further example, in a preferred embodiment, alumina (aluminium oxide or bauxite), which has a melting point higher than the maximum temperature of any conventional glass heating regime, provides an effective barrier to the migration of glass frit from the ceramic ink layers to a glass substrate outside the print pattern, within the stencil pattern. The alumina does not fuse to a glass substrate.

As another example, in reducing the invention to practice, it has been found that the constituents of Ferro 20-8543, which comprises alumina (aluminium oxide or bauxite), a product normally mixed with a clear or coloured ceramic ink to provide an etch effect, added to Ferro ink medium 1597, makes a suitable stencil ink 20. This stencil ink can be printed accurately on glass sheet 10 to define the print pattern but will not bond strongly to the glass before, during or after firing. Furthermore, during the heat process, the ink medium expulsion from this stencil ink layer 20 typically causes the ink layers above to erupt, further enabling the subsequent removal outside the print pattern 40 of stencil ink layer 20 and the ink layers 21 and 25 above the stencil ink layer 20.

It has also been shown in reducing the invention to practice that Ferro 20-8101 high opacity White with Ferro ink medium 1597 is suitable for ink layer 21 and Ferro 24-8029 Black with Ferro ink medium 1597 is suitable for ink layer 25.

Viscosity is an important ink parameter. Temperature affects the viscosity or flowability of the ink. A viscometer with a rotating spindle is optionally used to measure the viscosity during ink preparation which optionally comprises mixing, stirring or shaking. For example, it has been found that using a No. 6 spindle @ 10 rpm, inks should preferably be thinned to a viscosity within a preferred range of 15,000-22,000 cps at 24° C. (75° F.), more preferably 17,000-20,000 cps at 24° C. (75° F.).

The inks are optionally applied by screenprinting and each layer thoroughly dried to substantially remove the solvent or solvents in the ink medium before printing the next layer, preferably using dryers comprising a forced hot air section and a cooling section.

A suitable heat fusing process comprises a typical glass tempering process, for example achieving a temperature within the range of 650° C.-700° C., then being reduced to 625° C.-635° C. before cold air quenching. Following this process, a high pressure water jet with a pressure 2500-3000 psi removes the unwanted ink from the panel, which is preferably then subjected to a conventional glass washing process to remove any ink residue.

In this first embodiment of the invention, owing to the stencil ink layer 20 containing ink medium, there is always more ink medium by weight per unit area in the ink layers outside the print pattern than within the print pattern, which ensures differential ink medium expulsion during the heat fusing process. Typically, the proportion by weight of the ink medium in the plurality of layers of ink upon commencement of the heat fusing process to the weight of molten glass frit in the plurality of layers of ink at the highest temperature of the heat fusing process is greater outside the print pattern than within the print pattern.

For example, the above materials and procedures have been found to be effective in producing a panel of black dots superimposed on white dots to form a durable and effective one-way vision panel, for example suited to privacy glazing. In use, the white side is illuminated in daylight from outside the building, obstructing or partially obstructing visibility into the building, whereas the black dots enable good visibility from inside the building through the window to outside.

EMBODIMENT 2

Figure 2A:
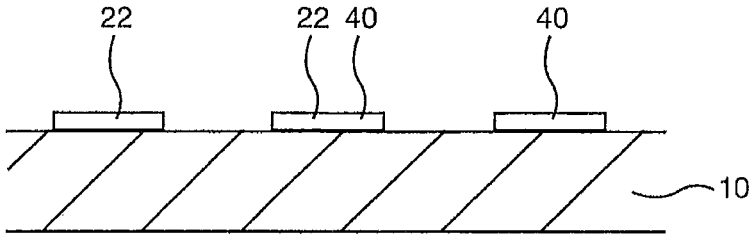
FIGS. 2A-2K are diagrammatic cross-sections of stages of the second embodiment in which the mask is within the print pattern.

Differential Expulsion of Ink Medium from Outside a Print Pattern Defined by a Direct Mask This second embodiment utilises different proportions of glass frit in the layers of ink and different proportions of ink medium, causing differential expulsion of ink medium between within and outside the print pattern. The print pattern is defined by a "direct mask" of the print pattern geometry, applied within the print pattern. In one example of this second embodiment, the direct mask comprises a ceramic first ink layer 22 applied, typically by screen printing, within print pattern portions 40, as shown in FIG. 2A. Ceramic first ink layer 22 has a relatively high proportion of glass frit typically greater than 60% by weight, preferably greater than 65% by weight, and more preferably greater than 70% by weight.

Figure 2B:
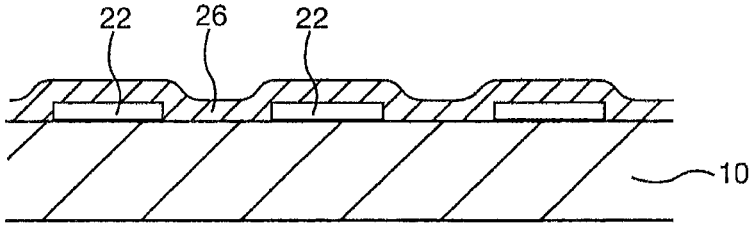

This direct mask, in the form of ceramic first ink layer 22, is overlain by ceramic second ink layer 26, illustrated in FIG. 2B. Ceramic second ink layer 26 has a lower proportion of glass frit than ceramic first ink layer 22 such that it can be removed from substrate 10 after firing. It has been found in experiments that the percentage of frit in ceramic second ink layer 26 can be as high as 21% and still enable substantial removal of unwanted second ink layer 26 from outside print pattern 40 following a heat fusing process.

Ceramic second ink layer 26 comprises a relatively low proportion of glass frit, typically less than 21% by weight, preferably less than 17% by weight and more preferably less than 13% by weight. Ceramic second ink layer 26 can otherwise be described as having a relatively high percentage of ink medium, typically greater than 30% by weight, preferably greater than 40% by weight and more preferably greater than 50% by weight.

Figure 2C:
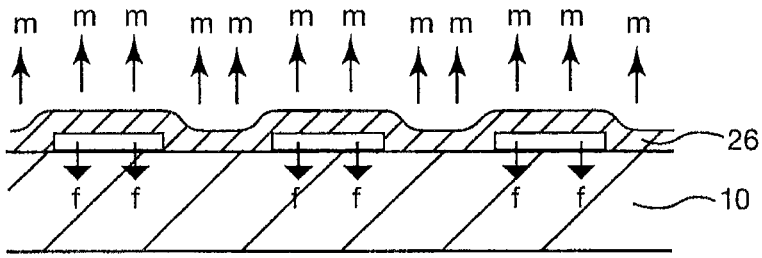
Figure 2D:
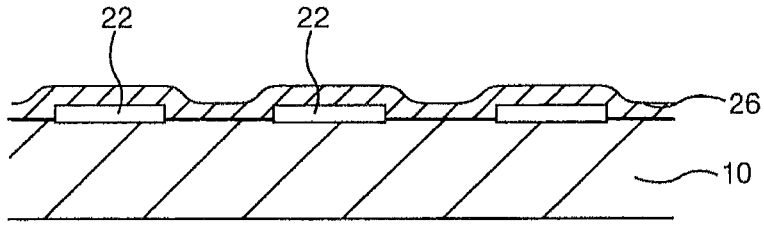
Figure 2E:
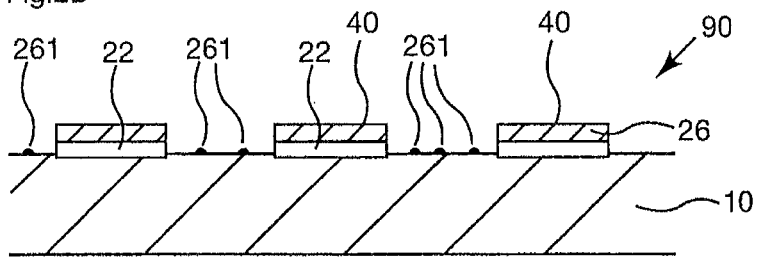

The printed and cured panel of FIG. 2B is subjected to a heat fusing process by being heated in a furnace to drive off ink medium as represented by the arrows 'm' in FIG. 2C. The ink medium emission continues and, as the temperature of the furnace is raised above the melting point of the glass frit in ink layers 22 and 26, the melted glass frit in first ink layer 22 is being fused to glass sheet 10, as represented by the arrows 'f'. The melted glass also binds the ink pigments in ink layers 22 and 26 to the glass surface within the print pattern portions 40 as shown diagrammatically in FIG. 2D. In contrast, in the parts of ink layer 26 outside the print pattern 40, the movement of typically liquid, gaseous or vapourised matter away from the surface of glass sheet 10 and the low percentage of glass frit prevents any substantial amount of solid pigment or molten frit outside the print pattern fusing or even bonding to any substantial degree to glass sheet 10. The higher proportion of ink medium to molten frit outside the print pattern typically causes the ink layer 26 to erupt. The unwanted ink layer 26 outside print pattern 40 is capable of substantial removal from outside the print pattern 40 following cooling and application of a removal force, for example by water or air jetting. Nevertheless, bonded particles 261 comprising fine particles of pigment are likely to be fused by very small quantities of glass frit to the glass surface and, in the context of this invention, "substantial removal from outside the print pattern" is defined as at least 90% removal by area and preferably greater than 95% removal by area, as measured by microscope or reduced light transmittance compared to the unprinted glass sheet. The possibility of such bonded particles 261 remaining is indicated in the finished panel 90 of FIG. 2E. If the finished panel 90 is a vision control panel, for example privacy glazing with a coloured or white ink layer 22 visible from outside a window and a black print pattern of ink layer 26 visible from inside the window to facilitate good vision out of the window, small black pigment particles 261 will not significantly detract from the view out or the aesthetic impression of the panel, as they will be hardly visible by the naked eye and not visible from a typical viewing distance of above 1 m.

During the heat fusing process, the continued differential emission of ink medium within print pattern 40 facilitates the migration of molten frit from ink layer 22 into ink layer 26, to boost the percentage of glass frit in ink layer 26 so that it binds the pigment in ink layer 26 to form a durable ink layer 26, and provides a more glossy appearance to ink layer 26 than would otherwise result. This compensation for the relatively low percentage of glass frit in ink layer 26 by a proportion of the relatively high percentage of frit in ink layer 22 reduces and preferably overcomes the problem of the prior art, enabling a substantially uniform glossy appearance to ink layer 26 in the finished product. Typically, the proportion by weight of the ink medium in the plurality of layers of ink upon commencement of the heat fusing process to the weight of molten glass frit in the plurality of layers of ink at the highest temperature of the heat fusing process is greater outside the print pattern than within the print pattern.

The method optionally comprises specially graded solids in the inks used. When conventional ceramic ink is "fired" and the ink medium is "burnt off", the ink layer will tend to "slump" or reduce in thickness, as the pigment moves within the melted frit, which takes up at least some of the voids between the pigment left by the removed ink medium. However, with ceramic ink with a low percentage of frit, the resultant structure of the ink and its residual thickness following firing will mainly depend upon the nature of the "grading" or "particle size distribution" of the pigment powder.

Any plurality of solid particles has a so-called "grading curve" or "particle distribution curve" which represents the proportions of different particle size ranges. In the field of civil engineering, for example in road construction or concrete mixes, this may be established and quantified by passing stone and sand through successive sieves with different aperture size. For smaller size particles such as found in ceramic ink pigments or glass frits, different techniques are required, such as the laser scattering technique, for example the HORIBA LA-920 manufactured by HORIBA, Ltd, which claims to measure particle size from 0.02 to 2000 microns. With composite materials such as ceramic ink and concrete, there can be benefit in providing a grading curve of solid materials such that finer solids tend to fill the gaps between larger solids. In concrete, the sand or "fine aggregate" fills the voids between "stone aggregate". In ceramic ink, finer pigment particles will also tend to fill the voids between larger pigment particles. Such a pigment particle distribution curve will tend to reduce the volume of molten frit required to bind the pigment and fuse a heat treated layer to a glass sheet and/or the other ceramic ink layers. However, it is also known in concrete and other particulate materials technologies for solids to have a "gap graded" grading curve. For example, if finer particles are omitted, there will be a higher proportion of interstices or voids between larger particles. Gap-graded pigment particles can be selected using paper filter and ultrasonic vibration techniques or air and cyclone systems. Such a gap-graded arrangement is advantageous in the present invention to enable the relatively easy migration of finely ground or molten glass frit from one layer to another and to minimise the migration of pigment from one layer or another, which would otherwise cause undesirable mixing of colours in one or more layers. This desired migration of frit (as opposed to pigment) between layers is optionally assisted by being carried by melted ink medium or vapourised ink medium being emitted in the heat process. The migration of frit within a molten ink medium is optionally further enabled by introducing an expanding agent into the ink medium.

In summary, the grading or particle distribution curve of both pigments and frit and the resin matrix characteristics can be selected in the different layers to optimise the method for example the redistribution of frit from the print pattern ink layer 22 to the ink layer 26 and any other ink layer.

The medium content of ceramic inks is typically based on the exposed surface area of the pigment and frit, typically ranging from 30-50% for decal printing and 15-30% for direct screening. For example, in practising the Second Embodiment, when printing ceramic ink onto glass to form a simple vision control panel comprising a print pattern of dots with two differently coloured layers, the first ("frit-loaded") mask layer defining the print pattern optionally comprises (by weight):

72% frit
10% pigment
18% medium
100% whereas the second (low frit content) layer optionally comprises:

20% frit
62% pigment
18% medium
100%

There are many variants to the disclosed embodiments, for example within this Second Embodiment, the mask is optionally not the first layer to be applied to the substrate 10.

Figure 2F:
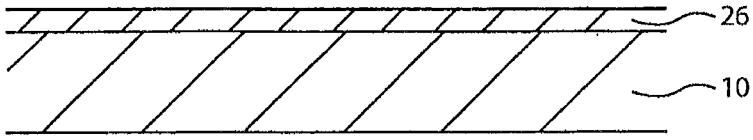
Figure 2G:
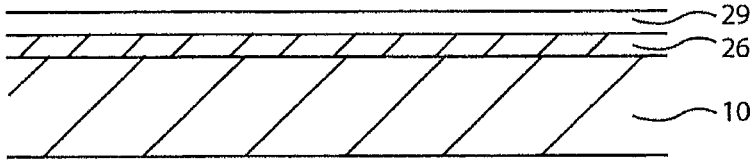
Figure 2H:
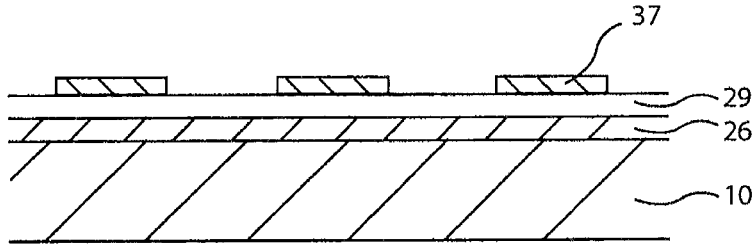
Figure 2I:
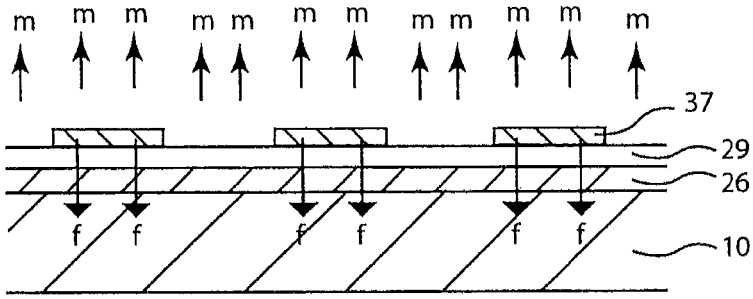
Figure 2J:
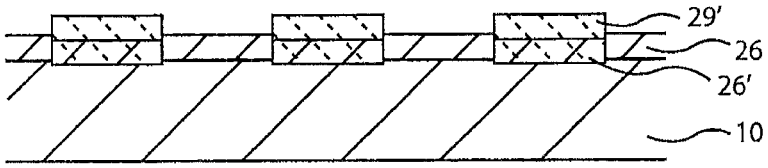
Figure 2K:
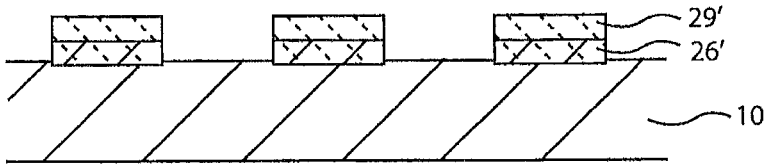

For example, to make a simple vision control panel, two uniform ceramic ink layers 26 and 29 with a relatively low proportion of glass frit, for example less than 21% glass frit, for example a light coloured layer, followed by a black ink layer, are applied uniformly over the substrate 10, followed by a mask ink layer 37 defining the print pattern comprising clear ceramic ink, for example comprising 80% glass frit and 20% ink medium with no coloured pigment, as shown in FIGS. 2F-2H. In FIG. 2I, there is differential thermal expulsion of medium m and fusing f of the ceramic ink layers 26 and 29 to glass substrate 10. In FIG. 2J, the frit in mask ink layer 37 migrates into ceramic ink layers 26 and 29 forming adapted ceramic ink layers 26 and 29 fused to glass substrate 10. Unwanted ceramic ink layers outside the print pattern are removed, for example by high pressure water jetting, to leave adapted ceramic ink layers 26 and 29 in substantially exact registration with the print pattern. This variant of the second embodiment overcomes the prior art problem of a matt finish to the exposed ink surface, as the frit-loaded mask layer on top of the pigmented ink layers will ensure that glass frit remains on or near the surface of the finished print pattern.

EMBODIMENT 3

Differential Ink Medium Emission using Glass Frits of Different Melting Points

In Embodiment 3, a "direct mask" layer defines the print pattern and is applied within the print pattern. Frits of different melting points are used in two ink layers, enabling both inks to have similar proportions of glass frit when printed but a high proportion of ink medium to molten frit outside the print pattern than within the print pattern in a heat fusing process, resulting in differential ink medium emission.

Figure 3A:
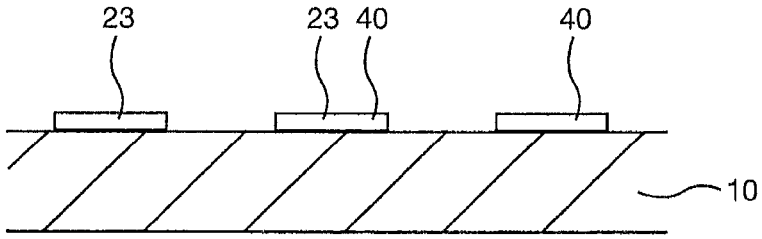
FIGS. 3A-3F are diagrammatic cross-sections of stages of the third embodiment in which the mask is within the print pattern and the layers comprise glass frits of differing melting points.

FIG. 3A illustrates the "direct mask", first ink layer 23, comprising a first glass frit of melting point t1, for example 550° C., applied within and defining the print pattern 40 to glass sheet 10 of melting point t3, for example 660° C.

Figure 3B:
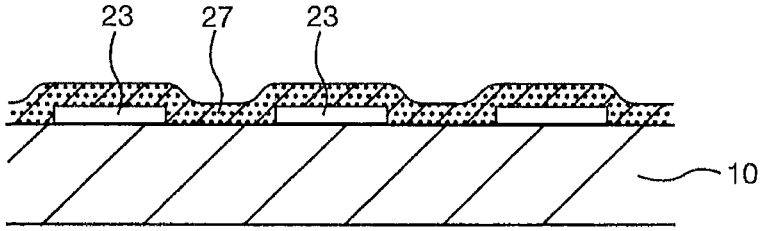
Figure 3C:
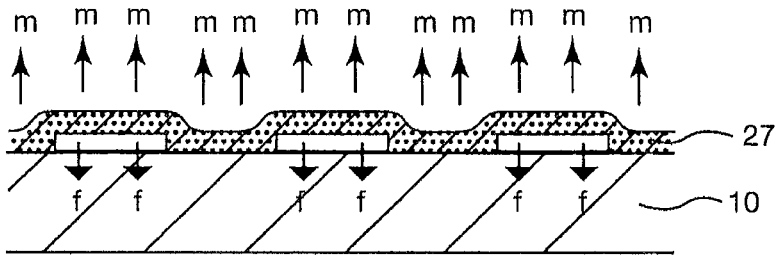
Figure 3D:
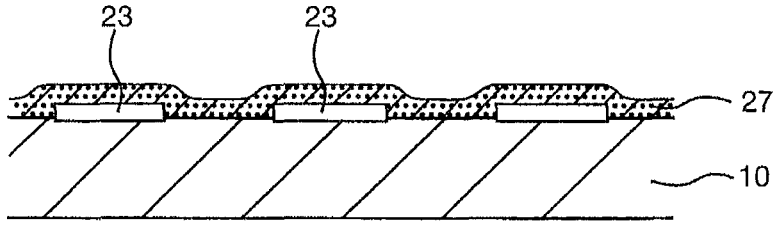
Figure 3E:
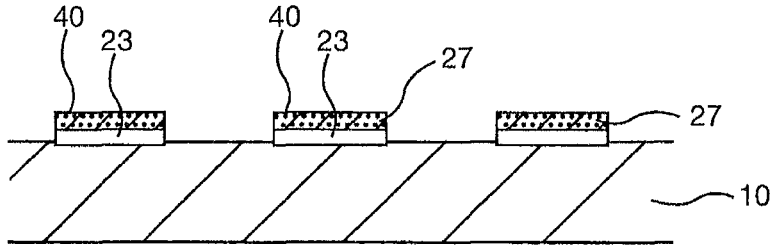
Figure 3F:
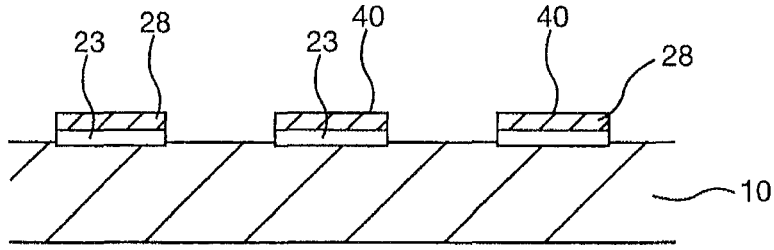

In FIG. 3B, ink layer 27 comprising a second glass frit of melting point t2, for example 600° C., is applied uniformly over ink layer 23 and the unprinted portions outside print pattern 40. In FIG. 3C, the panel of FIG. 3B is subjected to a heat fusing process or thermal treatment regime in a glass furnace up to a temperature higher than t1 but lower than t2, for example 570° C., when first glass frit in ink layer 23 and glass sheet 10 fuse together. The differential ink medium emission from ink layer 22 within the print pattern assists in the movement of molten first glass frit from ink layer 22 into ink layer 27 to bind, grip and partially encapsulate the pigment and unmelted second glass frit in ink layer 27, during which time the ink medium emission from the portions of single ink layer 27 outside print pattern 40 is typically completed without the second ink frit being melted. Following gradual cooling, the resultant panel of FIG. 3D is subjected to a force, for example water or air jetting, to remove the pigment and second glass frit and any residual ink medium from outside print pattern 40, leaving ink layers 23 and 27 within print pattern 40 in substantially exact registration, as illustrated in FIG. 3E. Typically, the proportion by weight of the ink medium in the plurality of layers of ink upon commencement of the heat fusing process to the weight of molten glass frit in the plurality of layers of ink at the highest temperature of the heat fusing process is greater outside the print pattern than within the print pattern.

The panel of FIG. 3E is then subjected to a second heat process, typically a glass tempering or toughening process in which the panel is raised to a temperature above t2, the melting point of second glass frit, up to a maximum of 670-700° C. It is then cooled rapidly by air jet to form a patina of precompression on each side of the glass panel.

Following this second heat process, in which second glass frit has been melted, it forms a glossy surface appearance to ink layer 28, transmuted by this heat process from ink layer 27.

A major advantage of this method is that the removal of unwanted portions of ink layer 23 before the glass tempering process removes the possibility, indeed likelihood, of furnace contamination by the glass cooling air jets removing particles of ink layer 23, which could cause deleterious impregnation of future glass processing in the same furnace.

Optionally, ink layer 27 also contains a relatively low percentage of first glass frit, typically below 21% by weight, which still enables the residual constituents of ink layer 23 to be substantially removed following the initial heat fusing process, in a similar manner to Embodiment 2.

EMBODIMENT 4

A Variant of Embodiment 1 Comprising a Design Ink Layer

Figure 4A:
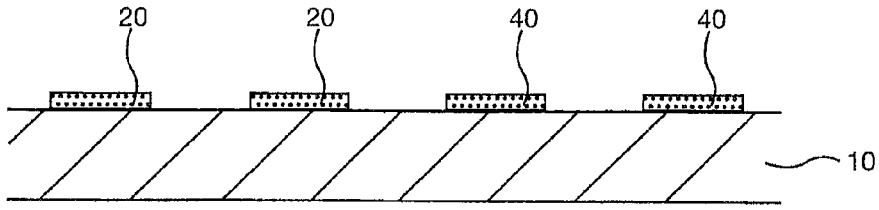
FIGS. 4A-4I are diagrammatic cross-sections of stages of the first embodiment also comprising a design layer.
Figure 4B:
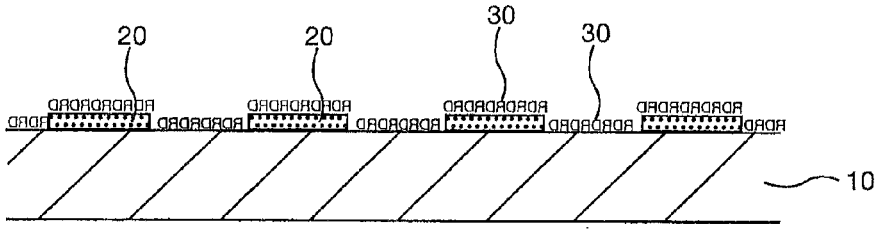

Embodiment 4 is similar to Embodiment 1, except that the plurality of layers of ink comprises a design layer comprising a design ink layer 30. For example, a design ink layer 30 is printed over the stencil layer 20 and the exposed, unprinted portions of glass sheet 10 of FIG. 4A, in the form of a reverse-reading design, in FIG. 4B. Design ink layer 30 optionally comprises a single spot colour or a plurality of spot colours or a full colour process, for example a four colour process layer of cyan, magenta, yellow and black (CMYK). The design ink layer 30 is, for example, screenprinted or applied by one of a variety of digital methods of printing ceramic ink, for example Glass Jet™ digital inkjet printing by equipment provided by Dip-Tech Ltd (Israel).

Figure 4C:
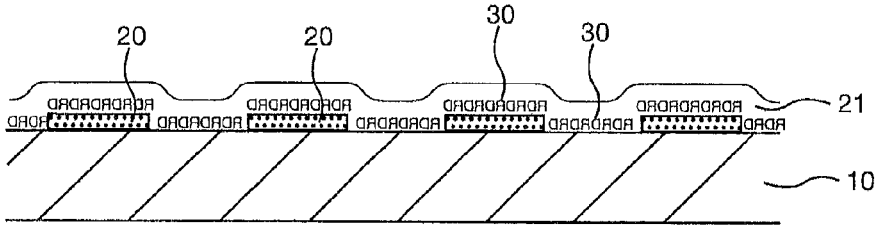
Figure 4D:
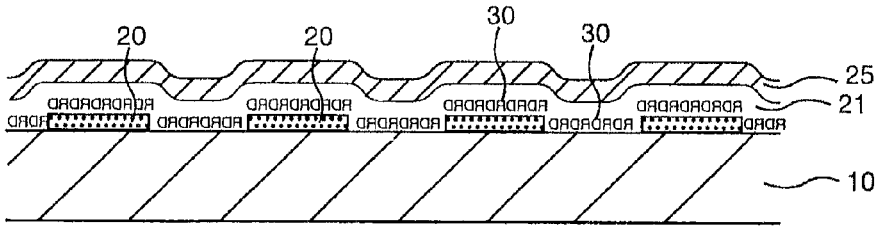
Figure 4E:
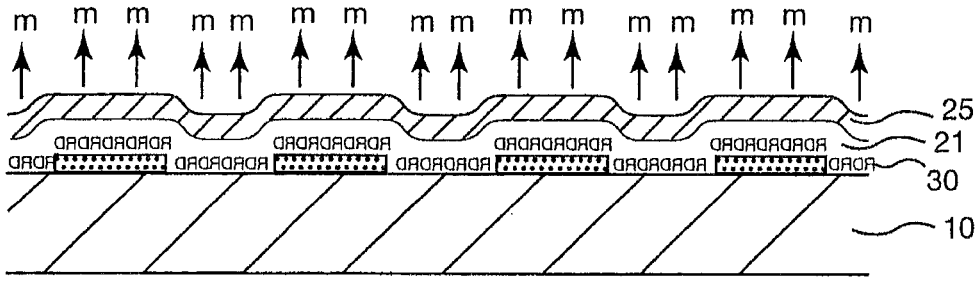
Figure 4F:
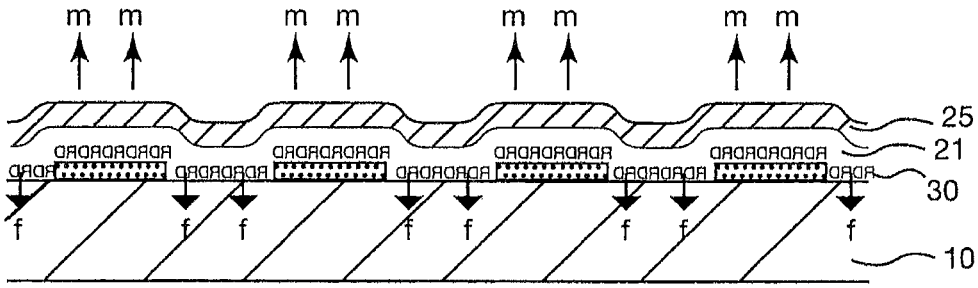
Figure 4G:
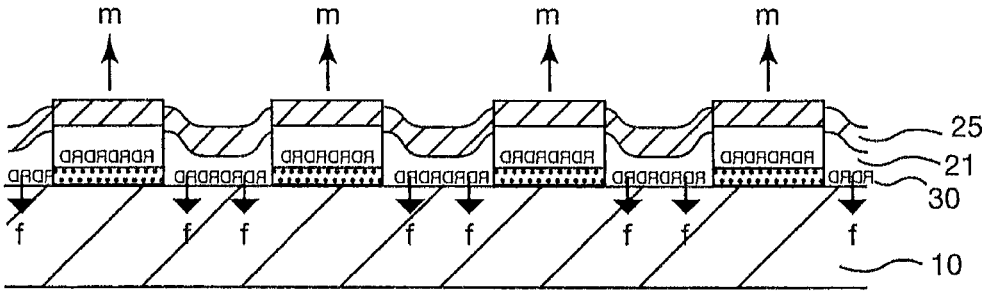
Figure 4H:
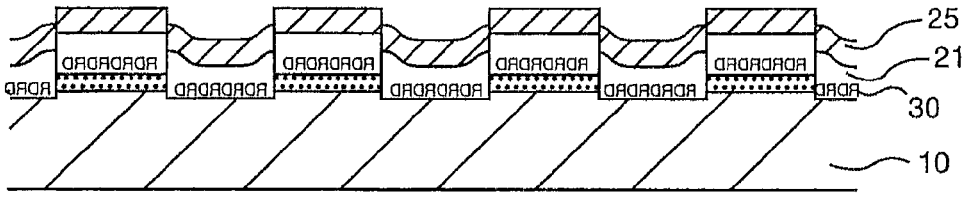
Figure 4I:
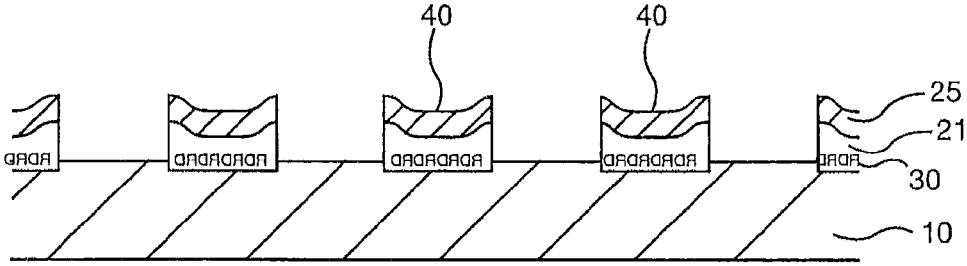

The reverse-reading design is visible right-reading from the other side of and through glass sheet 10. Ink layers 21 and 25 are then applied in FIGS. 4C and 4D. FIGS. 4E-4I follow the production stages of FIGS. 1D-1H, leaving design layer 30 and ink layers 21 and 25 within print pattern 40 in substantially exact registration.

To make a one-way vision, see-through graphic panel according to U.S. Pat. No. RE37,186, ink layer 21 is typically white, to act as a background layer to the colour or colours of design ink layer 30, and ink layer 25 is typically black, to provide good through vision from the printed side of the panel to the other side of the panel, from where the design is clearly visible. It should be understood that there are many potential variants to the described embodiments. For example, in this Embodiment 4, the design ink layer 30 is optionally printed right-reading onto a white ink layer 25, on a black ink layer 21, over stencil layer 20, resulting in a panel with a design visible from the printed side of the panel and enabling good through vision from the unprinted side.

EMBODIMENT 5

A Variant of Embodiment 2 Comprising a Design Ink Layer

Embodiment 5 is similar to embodiment 2 except that it comprises a design layer comprising a design ink layer 31.

Figure 5A:
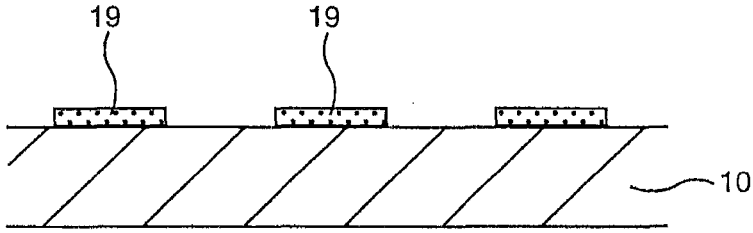
FIGS. 5A-5G are diagrammatic cross-sections of stages of the second embodiment also comprising a design layer.
Figure 5B:
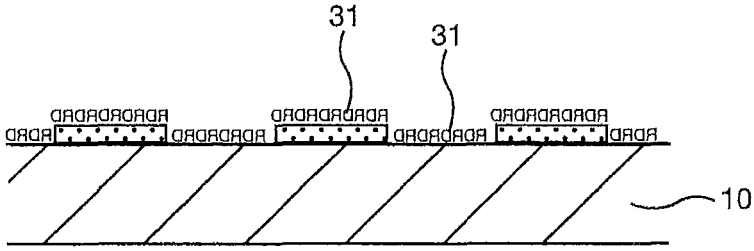
Figure 5C:
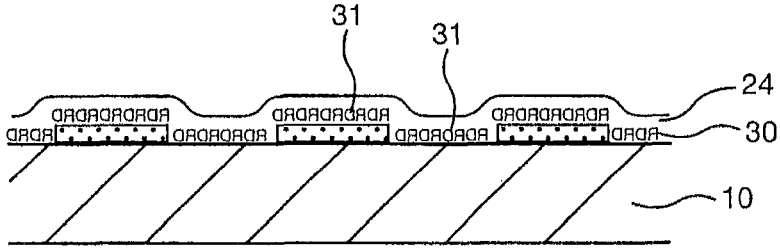
Figure 5D:
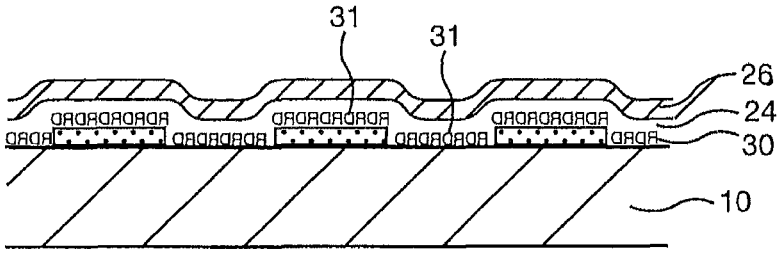
Figure 5E:
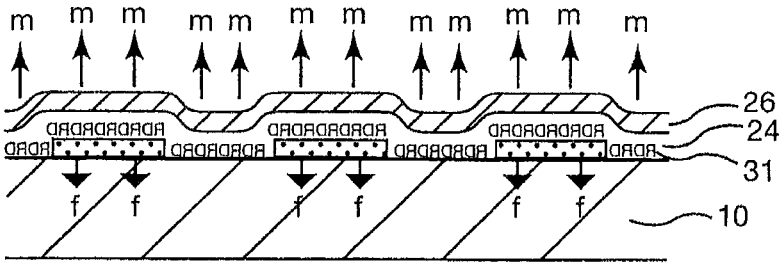
Figure 5F:
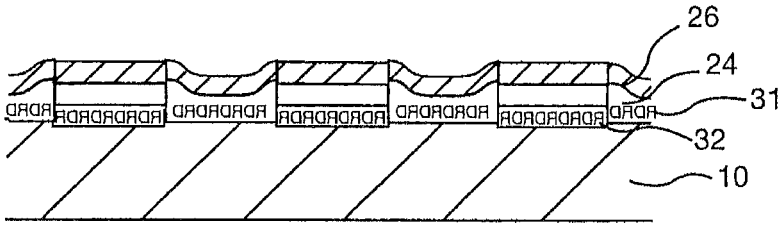
Figure 5G:
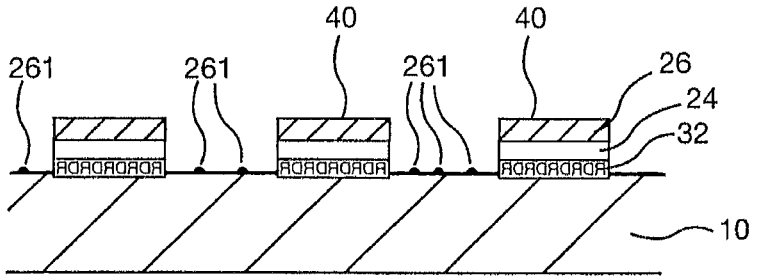

A clear, transparent ink layer 19 is printed onto glass sheet 10 in the form of the print pattern 40, in FIG. 5A. Ink layer 19 comprises a relatively high proportion of glass frit, for example 70% by weight. Design ink layer 31 is printed reverse-reading over transparent ink layer 19 and the unprinted portions of glass sheet 10, such that the design is visible right-reading through glass sheet 10 and transparent ink layer 19, as shown in FIG. 5B. Design ink layer 31 comprises a relatively low percentage of glass frit, preferably less than 21% by weight, as do the following ink layers 24 and 26 in FIGS. 5C and 5D respectively. FIGS. 5E-5G correspond to the production stages of FIGS. 2C-2E, except that design ink layer 31 and transparent ink layer 19 tend to fuse into design ink layer 32 visible through glass sheet 10 in FIGS. 5F and G. If ink layer 24 is white and ink layer 26 is black, to make a one-way vision panel according to GB 2 165 292, design ink layer 32 is visible from the non-printed side of the glass sheet 10 but is not visible from the printed side, which provides good vision through the panel.

EMBODIMENT 6

A Variant of Embodiment 3 Comprising a Design Ink Layer

As another method of incorporating a design to form a one-way vision panel according to GB 2 165 292, the method of Embodiment 3 can be adapted, for example ink layer 23 comprising glass frit 1 being black to provide good through vision from the unprinted side of glass sheet 10, ink layer 27 comprising glass frit 2 being white, overprinted by a design ink layer also optionally containing the second glass frit of melting point t2, the other production stages being according to Embodiment 3.

As an example of another type of see-through graphic panel, the ink layer 23 comprising the second glass frit of Embodiment 3 is white and a translucent design ink layer optionally comprising the second glass frit is substituted for ink layer 27, to form a see-through graphics panel with a translucent 'base layer' 23 and a translucent design layer according to EP 0 880 439.

Figure 6B:
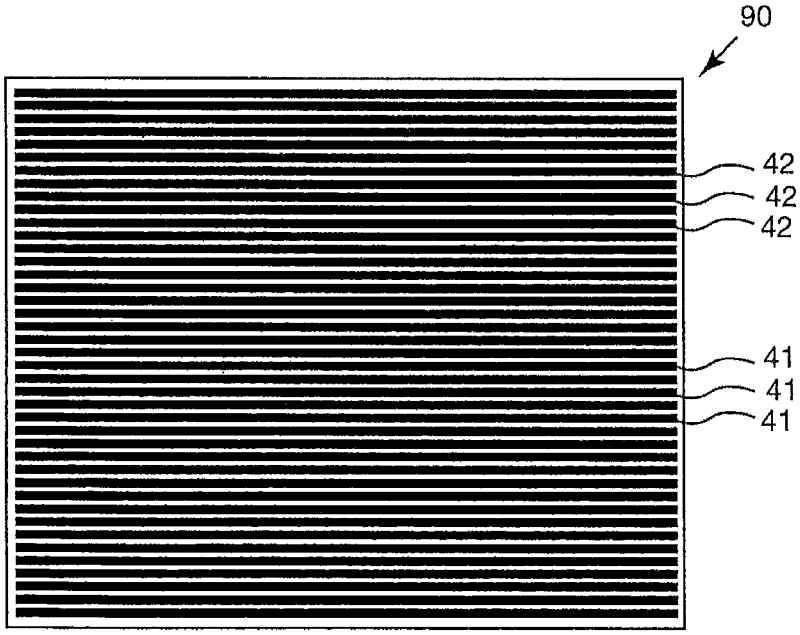

FIG. 6A illustrates one side of a see-through graphic panel 90 with design layer 33 visible within print pattern lines 41. FIG. 6B illustrates the other side of panel 90 comprising black lines 42 exactly registered with the design layer 33 within print pattern 40, enabling good through vision of objects spaced from the one side of panel 90.

In all these example embodiments of the invention glass frit and ink medium are provided both within and outside the print pattern and typically the proportion by weight of the ink medium in the plurality of layers of ink upon commencement of the heat fusing process to the weight of molten glass frit in the plurality of layers of ink at the highest temperature of the heat fusing process is greater outside the print pattern than within the print pattern. This enables the differential expulsion of the ink medium and consequent differential adhesion of ink to the substrate within the print pattern in contrast to outside the print pattern from where it is removed.

It should be understood that, in all the example embodiments, the layers of ink can be applied to glass panel 10 by direct or indirect decal, as an alternative to direct printing onto glass sheet 10.

Optionally the ink medium or mediums comprise bismuth oxide.

Direct printing onto glass is typically advantageous as the colour pigment to medium ratio used for direct printing is typically much higher than used for decal printing, so there is less organic material to be removed during the firing process.

Decal and direct methods of printing are optionally combined. For example in the first embodiment, the stencil ink layer is optionally applied as a decal and the following ink layers directly printed. As another example, a decal comprising a stencil ink layer and one or more subsequent ink layers, for example to produce a one-way vision panel comprising white on black ink layers, are optionally applied as a decal, optionally followed by a design ink layer printed directly. The white on black layers of the finished product are thereby optionally produced in relatively large quantity, enabling see-through graphic panels with individual designs to be produced more economically.

It should also be understood that there are many more embodiments of the invention than those illustrated and/or described.

The invention claimed is:

1. A method of partially imaging a substrate with a plurality of layers within a print pattern which subdivides the substrate into a plurality of discrete printed areas and/or a plurality of discrete unprinted areas, said layers being in substantially exact registration, said method comprising the steps of:

(i) applying a plurality of layers of ink to the substrate, wherein one of said layers of ink comprises a mask ink layer located within said print pattern and which defines said print pattern, said mask ink layer comprising pigment and glass frit, and another of said layers of ink comprises pigment and glass frit, wherein said another of said layers of ink comprises a lower proportion of glass frit than the proportion of glass frit in said mask layer, (ii) subjecting said substrate and said plurality of layers of ink to a heat fusing process, wherein during said heat fusing process, said pigment and said glass frit in said mask layer and said another layer form a durable image material adhered to said substrate within said print pattern and do not form a durable image material outside said print pattern, and (iii) removing parts of said another of said layers outside said print pattern, wherein said parts are burnt off and/or vapourised during said heat fusing process and/or are substantially removed by a subsequent finishing process.

2. A method as claimed in claim 1, wherein the print pattern comprises a plurality of superimposed layers of ink with a common length of boundary.

3. A method as claimed in claim 1, wherein said print pattern comprises a plurality of discrete printed areas, and wherein one of said discrete printed areas is of a different colour and is spaced from another of said discrete printed areas.

4. A method as claimed in claim 1, wherein said mask ink layer comprises greater than 60% by weight of glass fit.

5. A method as claimed in claim 1, wherein in said another of said layers of ink said glass frit comprises less than 21% by weight of wet ink of said another of said layers of ink.

6. A method as claimed in claim 1, wherein said mask ink layer comprises a first glass frit of a first melting point, and said another ink layer comprises a second glass frit of a second melting point, and wherein said heat fusing process comprises a maximum temperature above said first melting point and below said second melting point, and wherein a part of said another layer of ink is removed outside said print pattern following said heat process.

7. A method as claimed in claim 6, wherein following said removal of said another ink layer outside said print pattern, said substrate and the remaining parts of said layers within said print pattern are subjected to a second heat process comprising a temperature above said second melting point.

8. A method as claimed in claim7, wherein said second heat process is a glass tempering process.

9. A method as claimed in claim 4, wherein said mask layer comprises greater than 65% by weight of glass frit.

10. A method as claimed in claim 4, wherein said mask layer comprises greater than 70% by weight of glass frit.

11. A method as claimed in claim 5, wherein said another of said layers comprises less than 17% by weight of glass frit.

12. A method as claimed in claim 5, wherein said another of said layers comprises less than 13% by weight of glass frit.

* * * * *